US008313214B2

(12) United States Patent
Liang et al.

(10) Patent No.: US 8,313,214 B2
(45) Date of Patent: Nov. 20, 2012

(54) DOUBLE-SIDED LED LAMP

(75) Inventors: Kun Liang, Shenzhen (CN); Ting Dong, Shenzhen (CN); Jian Yuan, Shenzhen (CN)

(73) Assignees: Hong Fu Jin Precision Industry (ShenZhen) Co., Ltd., Shenzhen, Guangdong Province (CN); Hon Hai Precision Industry Co., Ltd., Tu-Cheng, New Taipei (TW)

( * ) Notice: Subject to any disclaimer, the term of this patent is extended or adjusted under 35 U.S.C. 154(b) by 221 days.

(21) Appl. No.: 12/882,155

(22) Filed: Sep. 14, 2010

(65) Prior Publication Data

US 2011/0176303 A1 Jul. 21, 2011

(30) Foreign Application Priority Data

Jan. 18, 2010 (CN) ..... 2010 1 0300396

(51) Int. Cl.
*F21V 1/00* (2006.01)
*F21V 13/10* (2006.01)

(52) U.S. Cl. .... 362/235; 362/246; 362/307; 362/311.02

(58) Field of Classification Search ..... 362/235–237, 362/245, 246, 307, 311.02, 311.04
See application file for complete search history.

(56) References Cited

U.S. PATENT DOCUMENTS

| | | | | |
|---|---|---|---|---|
| 4,345,308 | A * | 8/1982 | Mouyard et al. | 362/332 |
| 4,922,384 | A * | 5/1990 | Torrence | 362/611 |
| 6,561,689 | B1 * | 5/2003 | Kidd et al. | 362/541 |
| 6,729,746 | B2 * | 5/2004 | Suehiro et al. | 362/241 |
| 6,948,838 | B2 * | 9/2005 | Kunstler | 362/545 |
| 7,654,689 | B2 * | 2/2010 | Chang | 362/248 |
| 7,815,355 | B2 * | 10/2010 | Thompson et al. | 362/560 |
| 7,883,232 | B2 * | 2/2011 | Bang | 362/97.3 |

FOREIGN PATENT DOCUMENTS

| | | |
|---|---|---|
| TW | 200622430 A | 7/2006 |
| TW | 200708843 A | 3/2007 |

* cited by examiner

*Primary Examiner* — Alan Cariaso
(74) *Attorney, Agent, or Firm* — Altis Law Group, Inc.

(57) ABSTRACT

A double-sided LED lamp includes a shell, a plastic circuit board (PCB) and an optical film. The shell is made of translucent or transparent material. The PCB includes a number of rows of LEDs for emitting light beams, and defines a number of rows of through holes. The optical film facing the LEDs can reflect some of the light beams through the number of holes and also allow some of the light beams to pass through.

5 Claims, 3 Drawing Sheets

DOUBLE-SIDED LED LAMP

BACKGROUND

1. Technical Field

The present disclosure relates to light-emitting diode (LED) lamps, especially to a double-sided LED lamp which can emit light from two sides.

2. Description of Related Art

A light-emitting diode (LED) lamp often includes a LED light-source module. The luminous angle of a single LED light-source module is narrow and limited. When a larger angle or more than one area needs to be lit, then several LED light-source modules must be used.

BRIEF DESCRIPTION OF THE DRAWINGS

Many aspects of the embodiments can be better understood with reference to the following drawings. The components in the drawings are not necessarily drawn to scale, the emphasis instead being placed upon clearly illustrating the principles of the embodiments. Moreover, in the drawings, like reference numerals designate corresponding parts throughout the several views.

DETAILED DESCRIPTION

Figure 1:
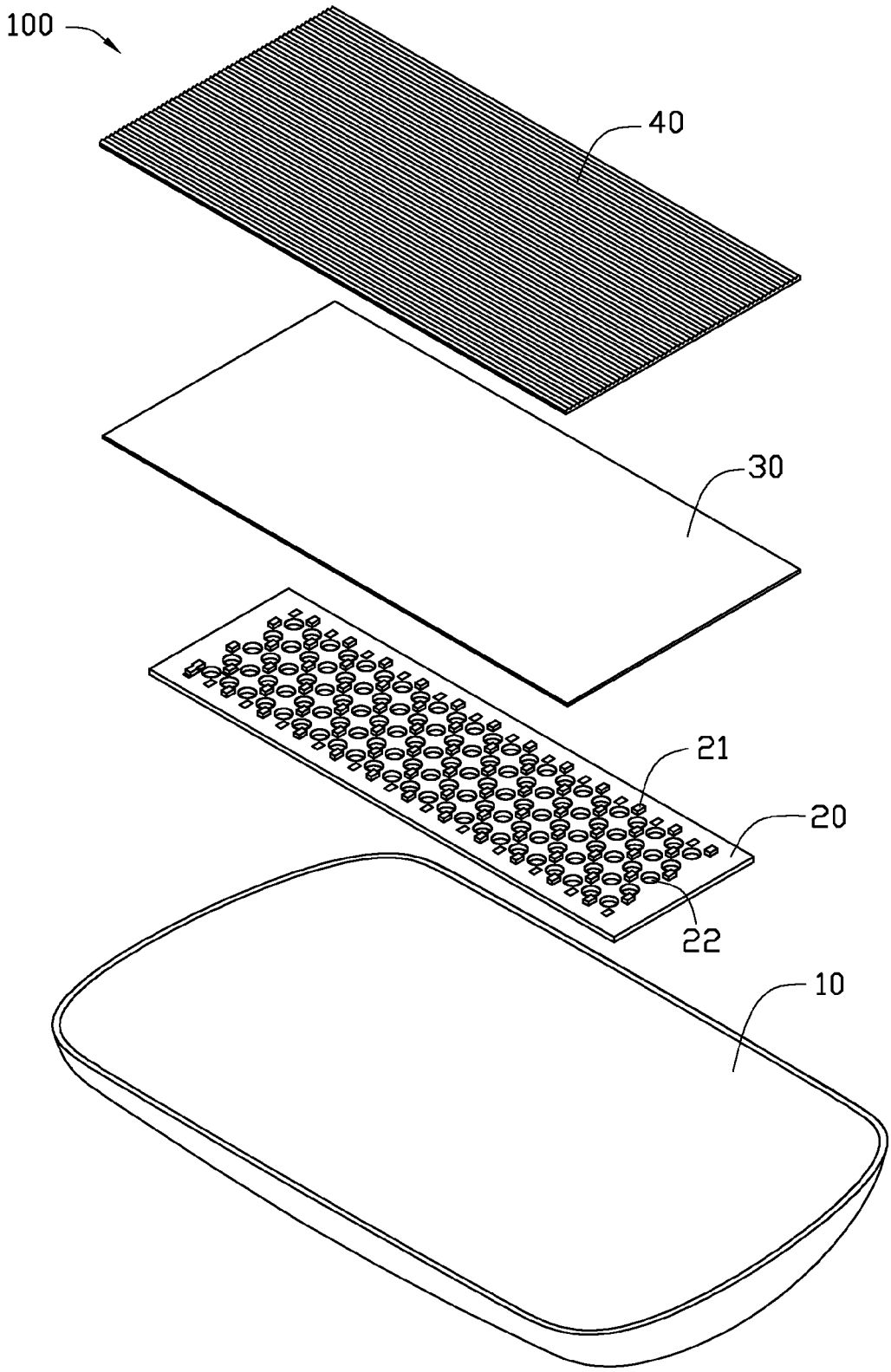
FIG. 1 is an exploded view of a double-sided LED lamp according to an exemplary embodiment.
Figure 2:
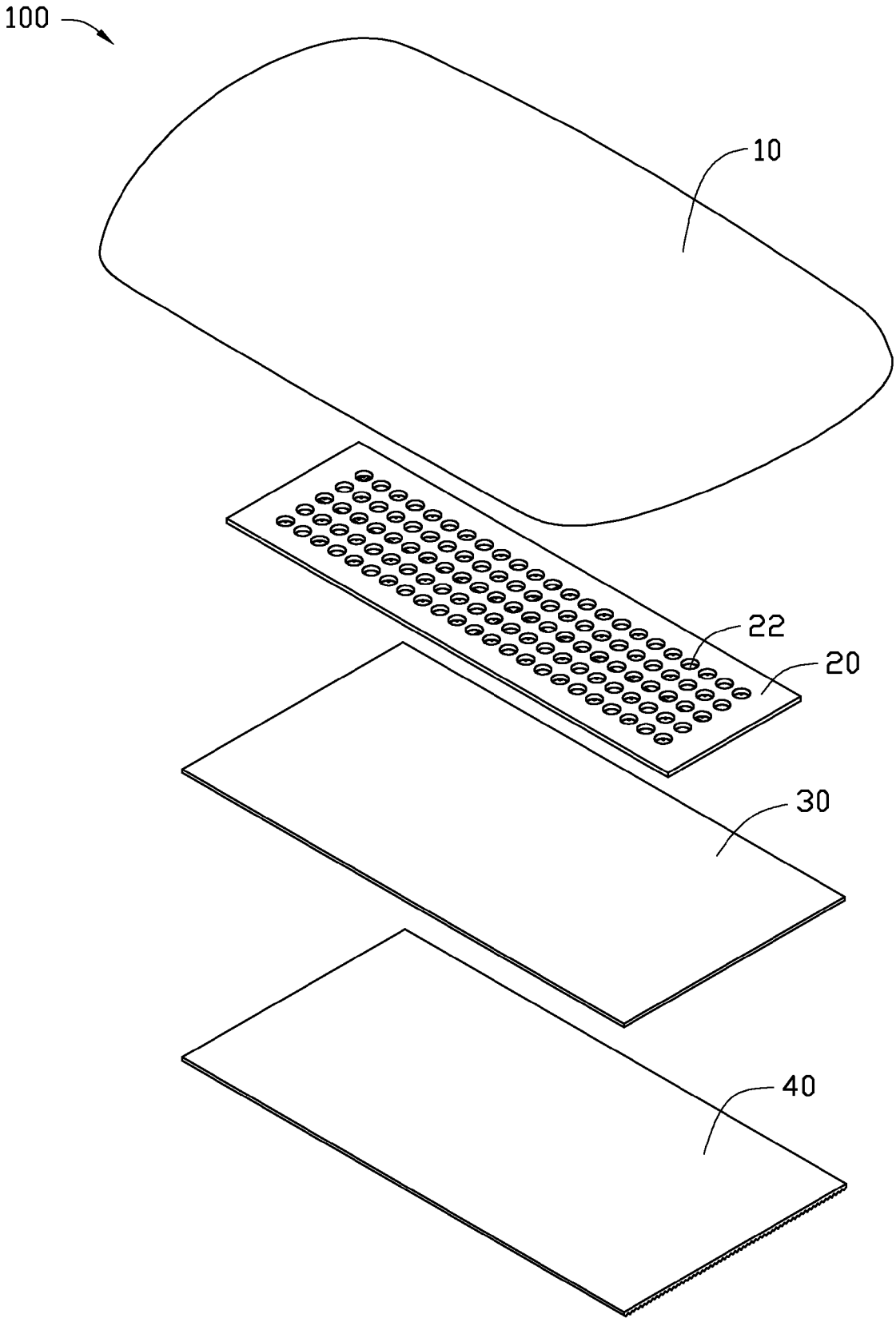
FIG. 2 is another exploded view of the double-sided LED lamp of FIG. 1 viewed from another viewpoint.

Referring to FIGS. 1-2, a double-sided light-emitting diode (LED) lamp 100 according to an exemplary embodiment includes a shell 10, a printed circuit board (PCB) 20, and an optical film 30. The shell 10 can be made of translucent or transparent material.

The PCB 20 is disposed in the shell 10 and includes a plurality of rows of light-emitting diodes 21 facing the optical film 30. The PCB 20 defines a plurality of rows of holes 22, which allows the reflected light beams from the optical film 30 to pass through. The rows of the light-emitting diodes 21 and the rows of the holes 22 are alternately arranged.

The optical film 30 can reflect some light beams and also allow some light beams to pass through. Portions of the light beams from the light-emitting diodes 21 can be reflected by the optical film 30 and travel to the translucent or transparent shell 10 through the holes 22. The optical film 30 can be a transflective sheet or a brightness enhancement film (BEF).

The double-sided LED lamp 100 further includes a diffusion sheet 40. The diffusion sheet 40 is used to diffuse the light beams from the LEDs 21. The diffusion sheet 40 is mounted on one side of the optical film 30 and faces away from the circuit board 20.

Figure 3:
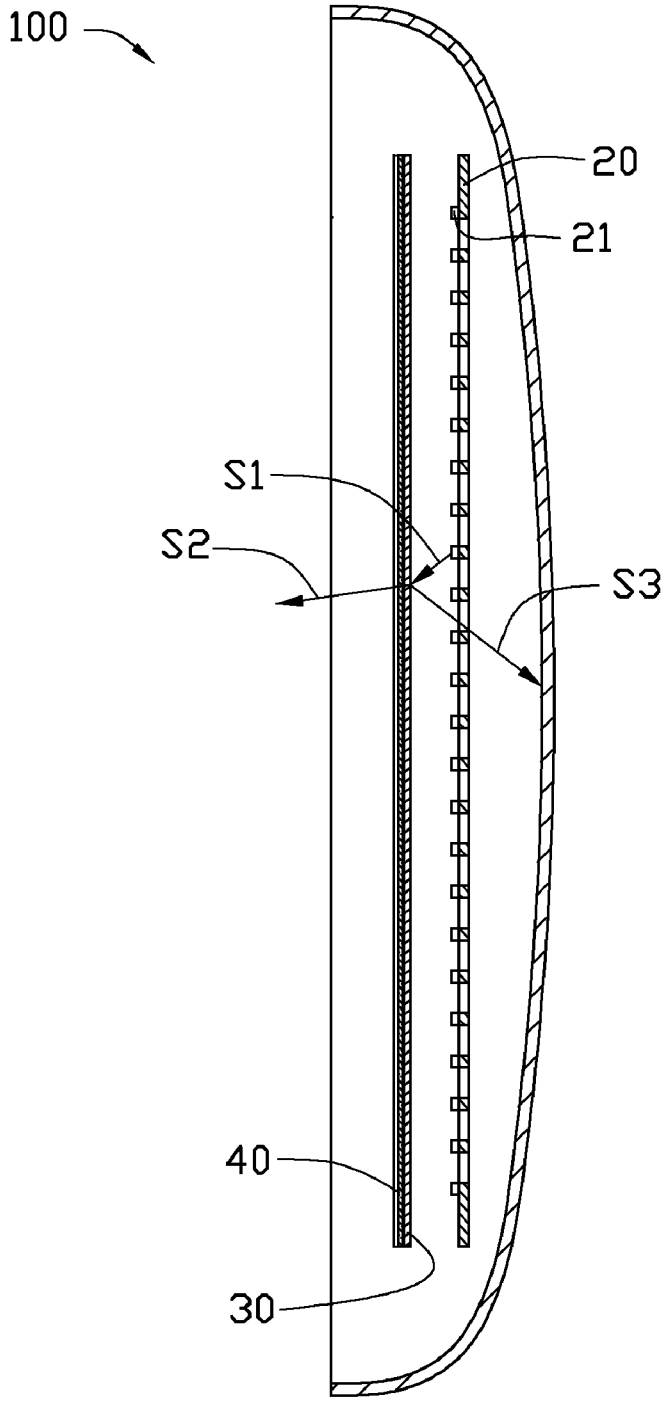
FIG. 3 is a schematic view illustrating the light path of the double-sided LED lamp.

Referring to FIG. 3, the light beam S1 from the LED 21 travels to the optical film 30 first. A portion of the light beam S1, i.e., the light beam S2 passes through the optical film 30 and the diffusion sheet 40, and comes out of the shell 10. The rest of the emitted light S1, i.e., the light beam S3 is reflected by the optical film 30. The reflected light beam S3 passes through the holes 22, and travels to and passes through the shell 10. With such structure, opposite sides of the double-sided LED lamp 100 can emit light.

It is to be understood, however, that even though numerous characteristics and advantages of the present disclosure have been set forth in the foregoing description, together with details of the structure and function of the present disclosure, the present disclosure is illustrative only, and changes may be made in detail, especially in matters of shape, size, and arrangement of parts within the principles of the present disclosure to the full extent indicated by the broad general meaning of the terms in which the appended claims are expressed.

What is claimed is:

1. A double-sided LED lamp comprising:

a shell made of translucent or transparent material;

a plastic circuit board (PCB) comprising a number of rows of LEDs for emitting light beams, and defining a number of rows of through holes; and an optical film facing the LEDs to reflect some of the light beams through the number of holes and also to allow some of the light beams to pass through.

2. The double-sided LED lamp of claim 1, wherein the rows of LEDs and the rows of the holes are alternately arranged.

3. The double-sided LED lamp of claim 1, further comprising a diffusion sheet, wherein the diffusion sheet is mounted on one side of the optical film and faces away from the circuit board to diffuse some of the light beams from the LEDs.

4. The double-sided LED lamp of claim 1, wherein the optical film is a transflective sheet.

5. The double-sided LED lamp of claim 1, wherein the optical film is a brightness enhancement film (BEF).

* * * * *